US010236632B2

(12) United States Patent
Zhang et al.

(10) Patent No.: US 10,236,632 B2
(45) Date of Patent: Mar. 19, 2019

(54) ELECTRICAL CONNECTOR FOR SAFELY CONVEYING HIGH VOLTAGE

(71) Applicant: FOXCONN INTERCONNECT TECHNOLOGY LIMITED, Grand Cayman (KY)

(72) Inventors: Jian-Li Zhang, HuaiAn (CN); Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/626,197

(22) Filed: Jun. 19, 2017

(65) Prior Publication Data

US 2017/0365951 A1 Dec. 21, 2017

(30) Foreign Application Priority Data

Jun. 17, 2016 (CN) ..... 2016 1 0432245

(51) Int. Cl.
*H01R 13/658* (2011.01)
*H01R 13/64* (2006.01)
(Continued)

(52) U.S. Cl.
CPC ..... *H01R 13/64* (2013.01); *H01R 13/50* (2013.01); *H01R 13/506* (2013.01);
(Continued)

(58) Field of Classification Search
CPC ..... H01R 13/658; H01R 13/6585; H01R 13/6586; H01R 23/688; H01R 13/6594;
(Continued)

(56) References Cited

U.S. PATENT DOCUMENTS 9,502,821 B2 11/2016 Ichikawa
2016/0020568 A1* 1/2016 Ju ..... H01R 24/78 439/607.01
(Continued)

FOREIGN PATENT DOCUMENTS

CN 203942066 11/2014
CN 204304072 U 4/2015
(Continued)

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

An electrical connector includes: an insulative housing having a base portion; a number of conductive terminals affixed to the insulative housing and arranged in two rows, each conductive terminal comprising a contacting portion, and each row of conductive terminals comprising a pair of grounding terminals and a number of internal terminals located between the pair of grounding terminals; a metal shielding plate affixed to the insulative housing and sandwiched between the two rows of conductive terminals; and a main shell enclosing the insulative housing; wherein a distance between the contacting portions of the internal terminals and the metal shielding plate is greater than a distance between the contacting portions of the grounding terminals and the metal shielding plate.

18 Claims, 12 Drawing Sheets

(51) Int. Cl.

| | |
|---|---|
| ***H01R 13/50*** | (2006.01) |
| ***H01R 13/6596*** | (2011.01) |
| ***H01R 24/60*** | (2011.01) |
| ***H01R 13/506*** | (2006.01) |
| ***H01R 13/6471*** | (2011.01) |
| ***H01R 13/6586*** | (2011.01) |
| *H01R 13/6585* | (2011.01) |
| *H01R 12/50* | (2011.01) |
| *H01R 24/00* | (2011.01) |
| *H01R 13/6594* | (2011.01) |
| *H01R 13/504* | (2006.01) |
| *H01R 13/6466* | (2011.01) |
| *H01R 107/00* | (2006.01) |
| *H01R 13/6581* | (2011.01) |
| *H01R 13/6595* | (2011.01) |
| *H01R 24/62* | (2011.01) |

(52) U.S. Cl.

CPC ..... *H01R 13/6471* (2013.01); *H01R 13/6586* (2013.01); *H01R 13/6596* (2013.01); *H01R 24/60* (2013.01); *H01R 13/504* (2013.01); *H01R 13/6466* (2013.01); *H01R 13/658* (2013.01); *H01R 13/6581* (2013.01); *H01R 13/6585* (2013.01); *H01R 13/6594* (2013.01); *H01R 13/6595* (2013.01); *H01R 23/02* (2013.01); *H01R 23/688* (2013.01); *H01R 24/62* (2013.01); *H01R 2107/00* (2013.01)

(58) Field of Classification Search

CPC .. H01R 13/504; H01R 23/02; H01R 13/6466; H01R 24/64

USPC ..... 439/660, 676, 607.57, 607.55, 607.05, 439/607.35

See application file for complete search history.

(56) References Cited

U.S. PATENT DOCUMENTS

2016/0197443 A1* 7/2016 Zhang ..... H01R 13/6585 439/607.05

2016/0315422 A1 10/2016 Cheng

FOREIGN PATENT DOCUMENTS

| | | | |
|---|---|---|---|
| CN | 204391414 | U | 6/2015 |
| CN | 204696302 | | 10/2015 |
| CN | 204696369 | U | 12/2015 |
| CN | 105244654 | | 1/2016 |
| CN | 105322386 | | 2/2016 |
| CN | 105552618 | A | 5/2016 |

* cited by examiner

ELECTRICAL CONNECTOR FOR SAFELY CONVEYING HIGH VOLTAGE

BACKGROUND OF THE DISCLOSURE

1. Field of the Disclosure

The present disclosure relates to an electrical connector, and more particularly to an electrical connector adapted for normally and reversely mating.

2. Description of Related Arts

China Patent No. 204391414 discloses a reversible or dual orientation USB Type-C plug connector comprising an insulative housing having a base portion and a tongue portion extending forwardly from the base portion, a shielding plate affixed to the tongue portion, and a plurality of terminals at an upper side and a lower side of the shielding plate in two rows. Each row of terminals comprises a plurality of high-speed terminals and non-high-speed terminals. A thickness of the portion of the shielding plate opposing the high-speed terminals is reduced to increase a distance between the shielding plate and the high-speed terminals for impedance matching consideration. U.S. Pat. No. 9,502,821 also discloses the similar/same structure with the similar/same function.

China Patent No. 105552618 discloses an insulative housing comprising a first tongue portion and a second tongue portion, a plurality of conductive terminals affixed to the insulative housing and categorized with a plurality of upper terminals and a plurality of lower terminals, and a conductive film located between the first tongue portion and second tongue portion and isolates the upper terminals from the lower terminals. Since the conductive film is thin, its distance from the conductive terminals is increased in order to reduce a risk of high-voltage break through.

An improved electrical connector is desired.

SUMMARY OF THE DISCLOSURE

Accordingly, an object of the present disclosure is to provide an electrical connector for safely conveying high voltage.

To achieve the above object, an electrical connector includes: an insulative housing comprising a base portion; a plurality of conductive terminals affixed to the insulative housing and arranged in two rows, each conductive terminal comprising a contacting portion, and each row of conductive terminals comprising a pair of grounding terminals and a plurality of internal terminals located between the pair of grounding terminals; a metal shielding plate affixed to the insulative housing and sandwiched between the two rows of conductive terminals; and a main shell enclosing the insulative housing; wherein a distance between the contacting portions of the internal terminals and the metal shielding plate is greater than a distance between the contacting portions of the grounding terminals and the metal shielding plate.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
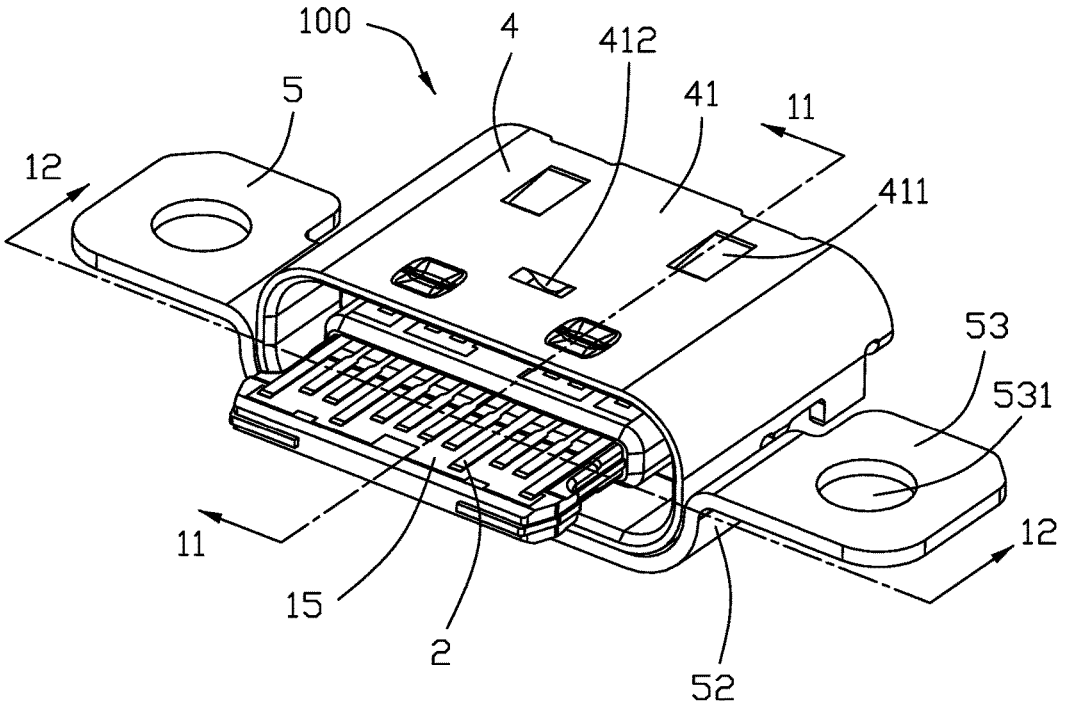
FIG. 1 is a perspective, assembled view of an electrical connector.
Figure 2:
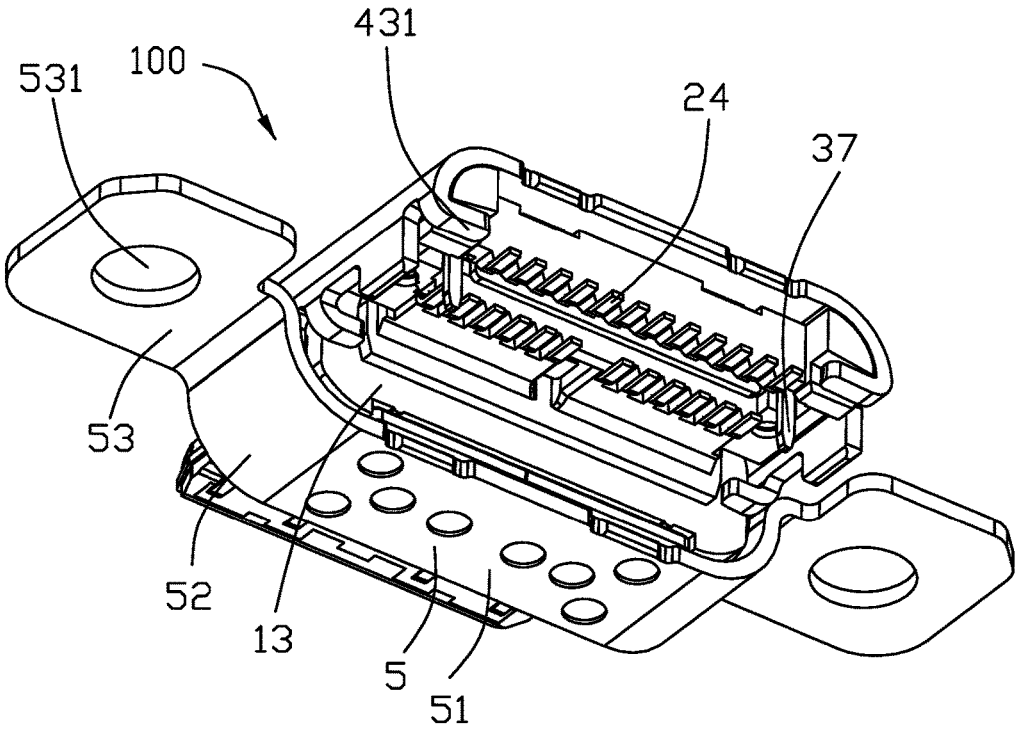
FIG. 2 is another perspective, assembled view of the electrical connector taken from FIG. 1.

Reference will now be made in detail to the embodiments of the present disclosure. The insertion direction is a front-to-rear direction.

Referring to FIGS. 1 to 9, an electrical connector 100 includes an insulative housing 1, a number of conductive terminals 2 affixed to the insulative housing 1, a metal shielding plate 3, a main shell 4 enclosing the insulative housing 1, and a metal shell 5 attached to the main shell 4.

Figure 5:
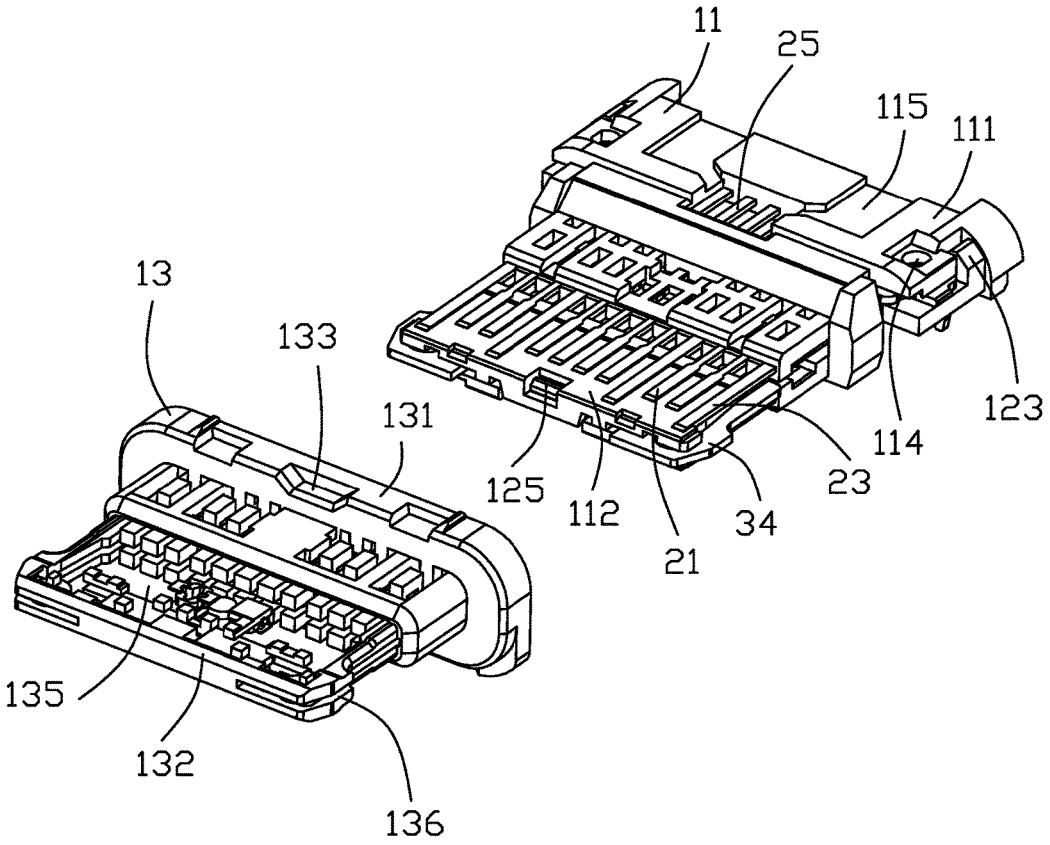
FIG. 5 is a partial exploded view of an insulative housing, a number of conductive terminals and a metal shielding plate in the electrical connector.
Figure 6:
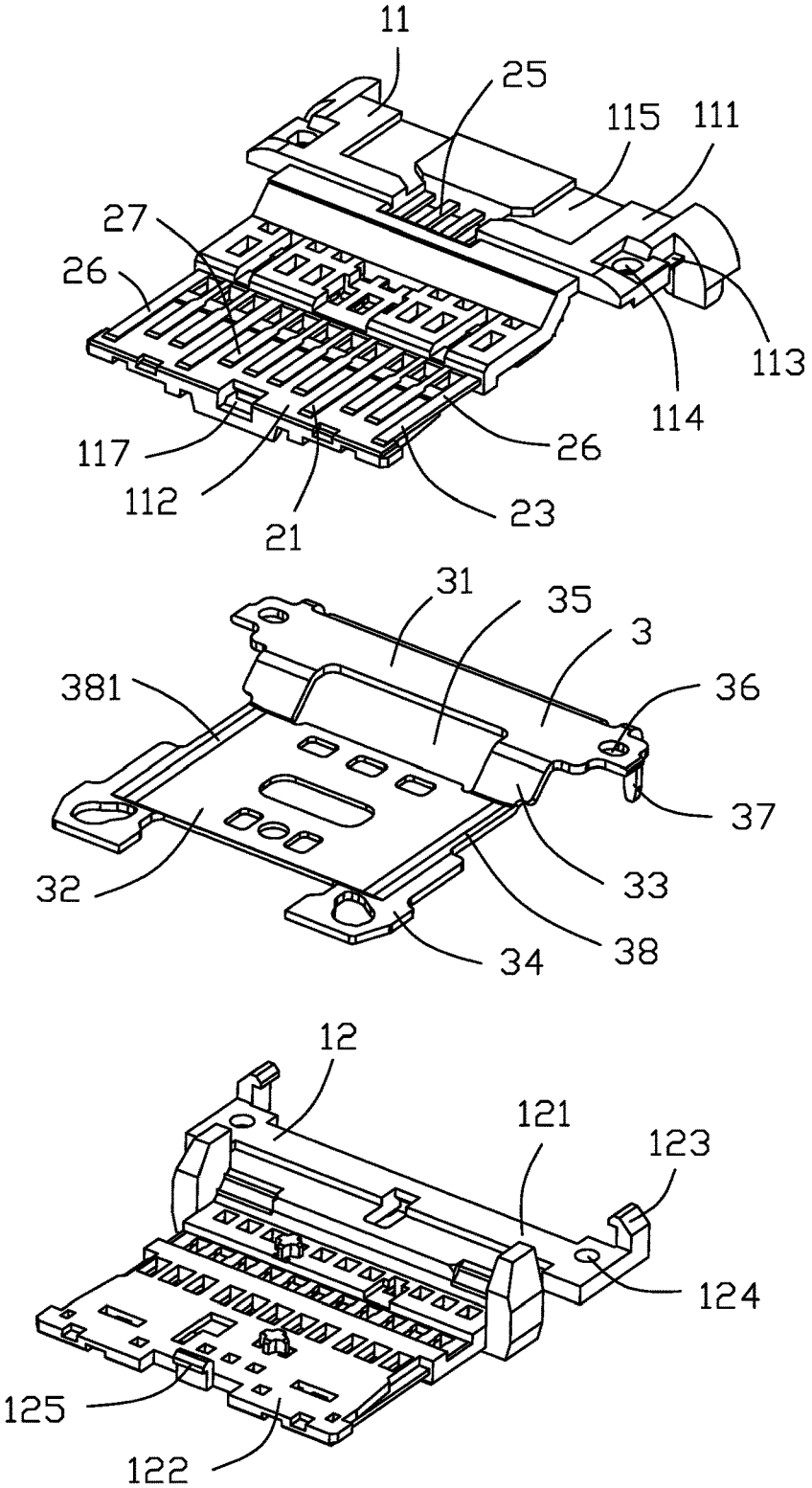
FIG. 6 is a partial exploded view of a first insulator, a second insulator, the conductive terminals and the metal shielding plate in the electrical connector.
Figure 7:
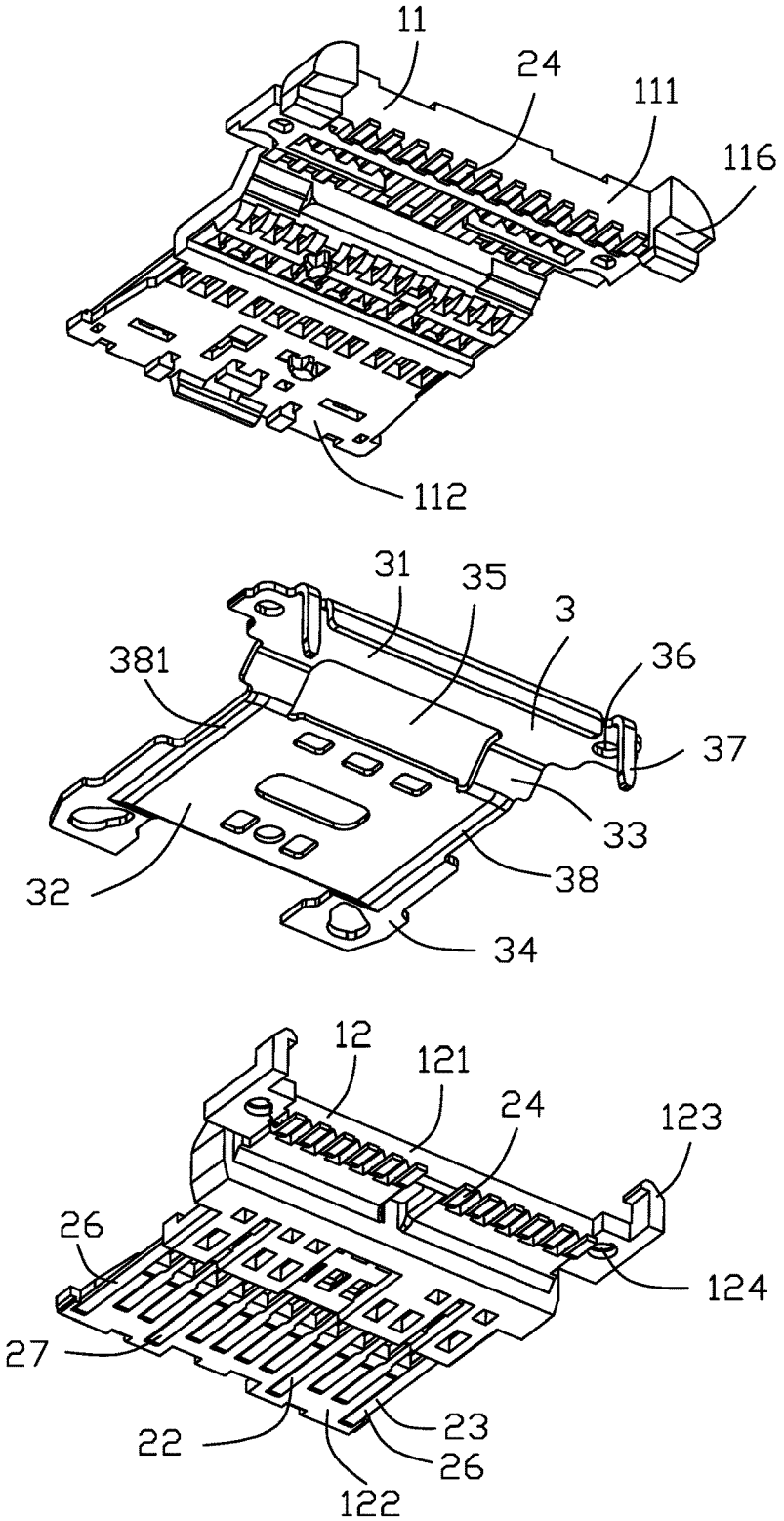
FIG. 7 is another partial exploded view of the electrical connector taken from FIG. 6.
Figure 8:
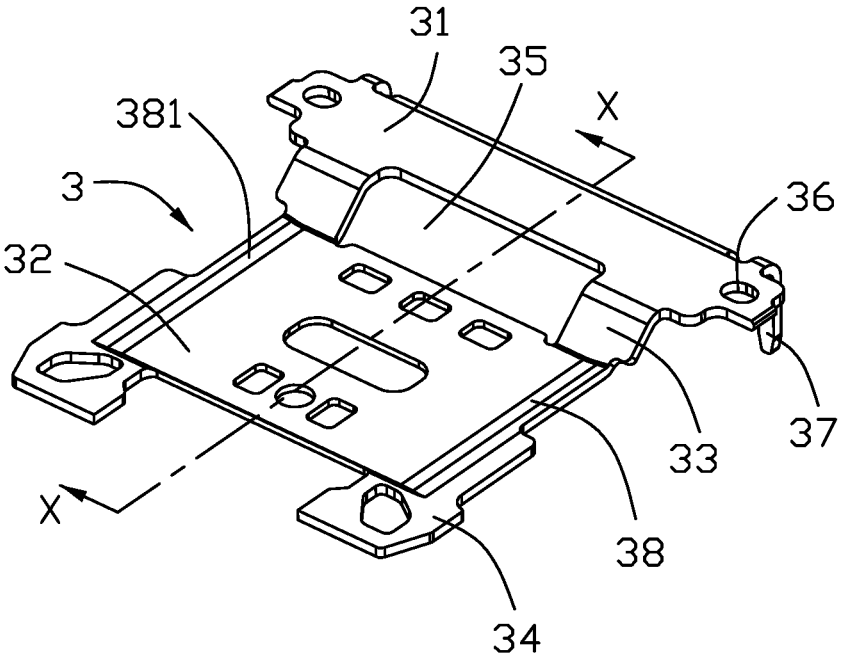
FIG. 8 is a perspective, stereoscopic view of the metal shielding plate of the electrical connector.
Figure 9:
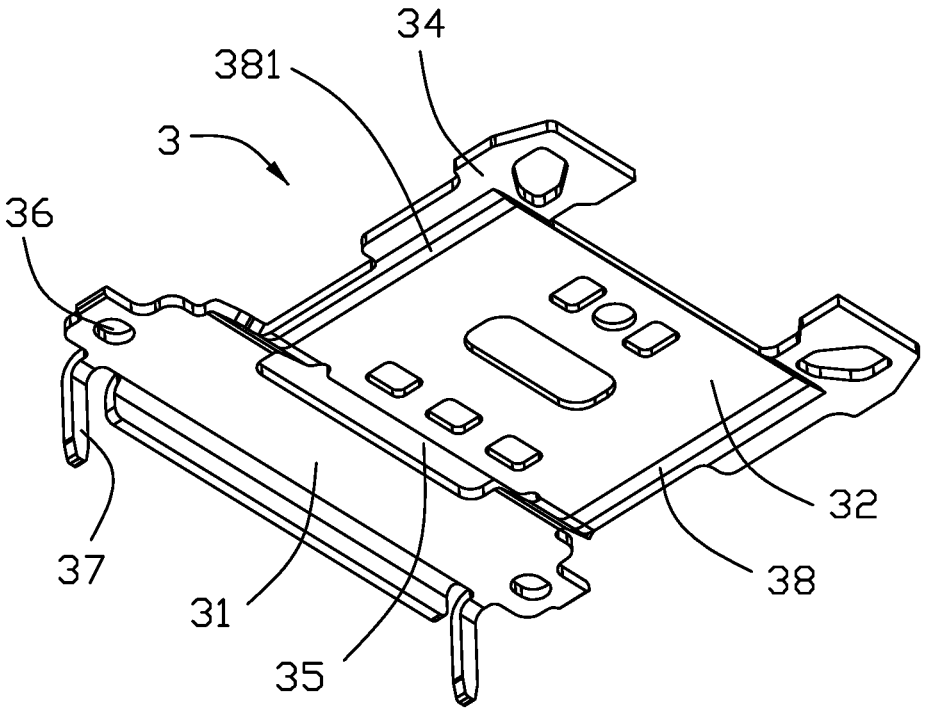
FIG. 9 is another perspective, stereoscopic view of the metal shielding plate taken from FIG. 8.
Figure 10:
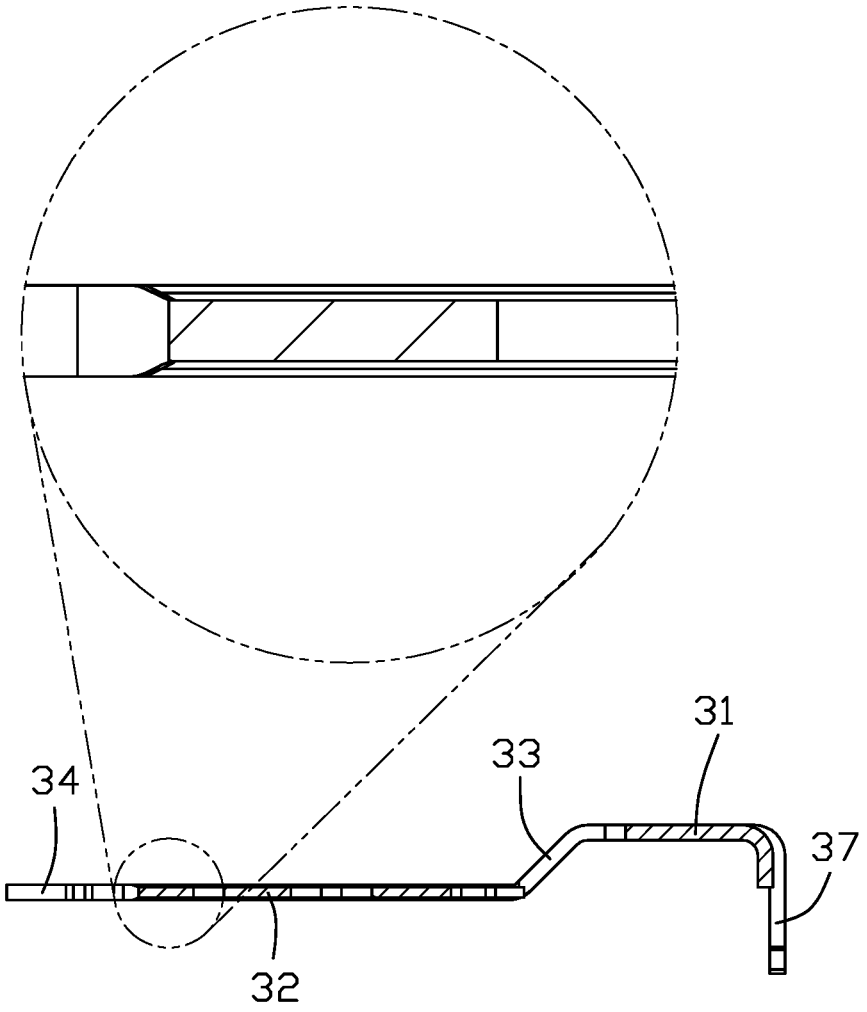
FIG. 10 is a cross-sectional view of the electrical connector taken along line 10-10 in FIG. 8.
Figure 11:
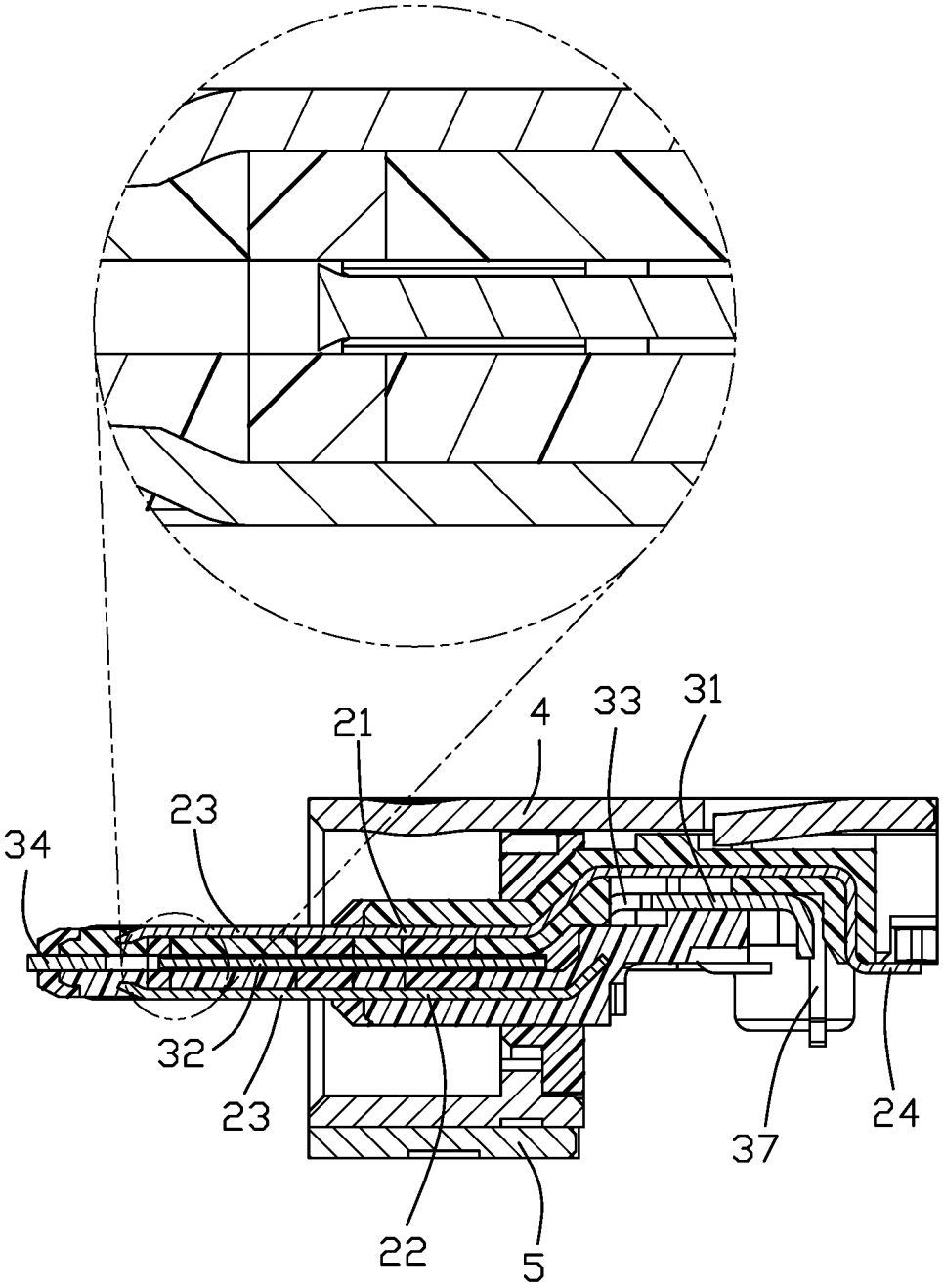
FIG. 11 is a cross-sectional view of the electrical connector taken along line 11-11 in FIG. 1.

Referring to FIGS. 5 to 7, the insulative housing 1 includes a base portion 14 and a tongue portion 15 extending forwardly in a front-to-back direction from the base portion 14. The insulative housing 1 further includes a first (basic) insulator 11 including a first base portion 111 and a first tongue portion 112 extending forwardly from the first base portion 111, a second (basic) insulator 12 assembled with the first insulator 11 and including a second base portion 121 and a second tongue portion 122 extending forwardly from the second base portion 121, and a third (supplemental) insulator 13 integrated with the first insulator 11 and the second insulator 12 and including a third base portion 131 and a third tongue portion 132 extending forwardly from the third base portion 131. The base portion 14 includes the first base portion 111, the second base portion 121 and the third base portion 131. The tongue portion 15 includes the first tongue portion 112, the second tongue portion 122 and the third tongue portion 132. The first base portion 111 includes a pair of first locking portions 113, a pair of first mating holes 114 located in front of the locking portions 113, a pair of slots 115 located at a upper surface thereof, and a pair of resisting grooves 116 located at two sides of a lower surface. The first tongue portion 112 includes a buckling hole 117 at a front end thereof. The second base portion 121 includes a pair of second locking portions 123 extending upwardly and a pair of second mating holes 124 located at front of the second locking portions 123. The second tongue portion 122 includes a buckling portion 125 at a front end thereof. The third base portion 131 includes a receiving groove 133 located at a middle of an upper surface and a pair of recesses located at a lower surface. The third tongue portion 132 includes a hollow section 135 and a pair of fixing grooves 136 located laterally.

The conductive terminals 2 are arranged in two rows including a row of upper terminals 21 and a row of lower terminals 22 in symmetry. Each row of conductive terminals includes a pair of grounding terminals 26 and a number of internal terminals 27 located between the grounding terminals 26. Each conductive terminal 2 includes a contacting portion 23, a soldering portion 24 and a fixing portion 25 connecting the contacting portion 23 and the soldering portion 24. Each contacting portion 23 of the upper terminals 21 is positioned in reverse symmetry with respect to a respective one of the lower terminals 22.

The metal shielding plate 3 includes a supporting portion 31 located at a rear end, a main portion 32, a pair of connecting portion 33 connecting the supporting portion 31 and the main portion 32, a pair of fixing protrusions 34 located at two sides of a front end thereof for locking/mating with a corresponded electrical connector, and a pair of inclining/side portions 38 located at a pair of outer edge of the main portion 32 and connecting with the fixing protrusions 34. Each inclining portion 38 includes an arc surface 381 inclined from the fixing protrusion 34 to the main portion 32 and connected the fixing protrusion 34 with the main portion 32. The connecting portion 33 includes a through hole 35 in a middle. The supporting portion 31 includes a pair of third mating holes 36 laterally and a pair of soldering pins 37 bending downwardly from a rear end of the supporting portion 31. The metal shielding sheet 3 is designed in a one-piece form and is punched at the main body portion 32 so that the upper and lower surfaces of the main body portion 32 are recessed inward from the plane of the upper and lower surfaces of the fixing protrusions 34, respectively. The thickness of the main portion 32 is less than that of the fixing protrusion 34, the supporting portion 31 and the connecting portion 33. The thickness of the inclining portion 38 is between the thickness of the main portion 32 and the fixing protrusions 34. The arc surface 381 inclined from the fixing protrusions 34 to the main portions 32. The thickness of the supporting portion 31, the connecting portion 33, and the fixing protrusions 24 meet the industry standard (0.15 mm). The thickness of the main portion 32 punched is 0.1 mm.

Figure 3:
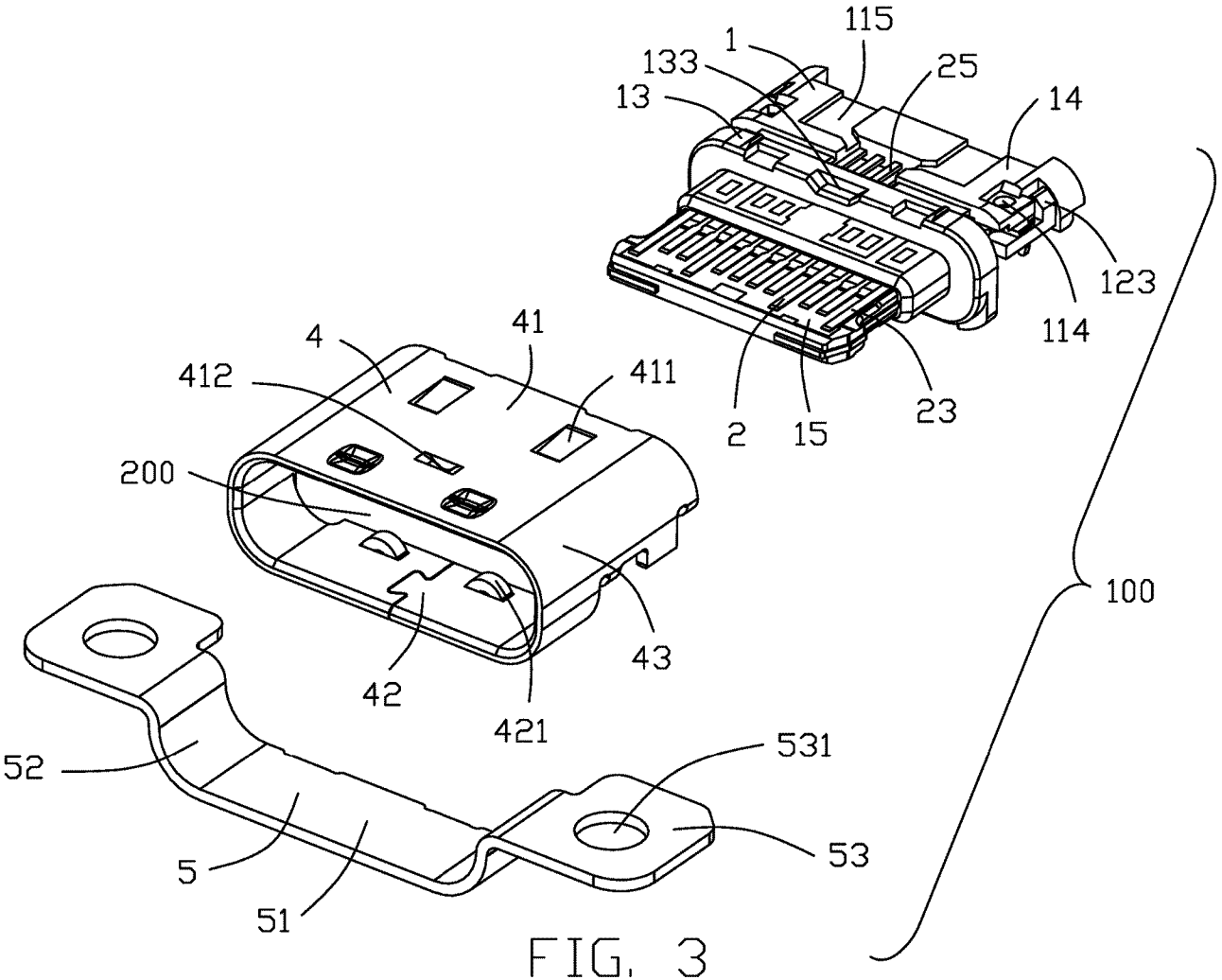
FIG. 3 is a partial exploded view of the electrical connector.
Figure 4:
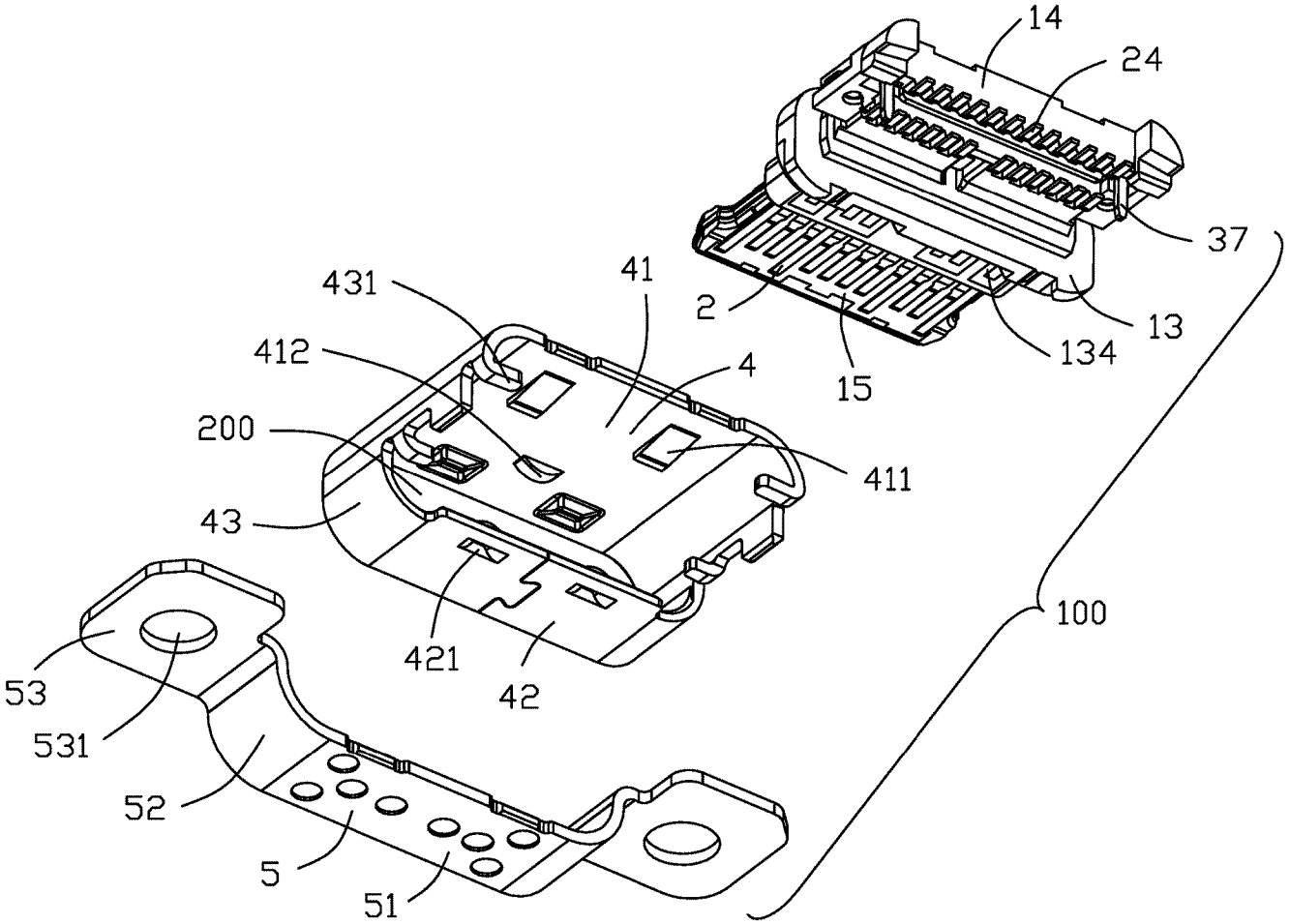
FIG. 4 is another partial exploded view of the electrical connector taken from FIG. 3.

Referring to FIGS. 3 to 4, the metal shell 4 includes an upper wall 41, a lower wall 42 opposite to the upper wall 41, and a pair of lateral walls 43 connecting the upper wall 41 and the lower wall 42 for forming a receiving room 200. The length of the upper wall 41 is longer than the length of the lower wall 42 in the front-to-rear direction. The upper wall 41 includes a pair of resisting portions 411 protruding into the receiving room 200, and a first tuber 412 located in front of the resisting portions 411. The lower wall 42 includes a pair of second tubers 421 protruding into the receiving room 200. The lateral walls 43 include four positioning pins 431 bending into the receiving room 200.

The metal shell 5 includes a bottom wall 51, a pair of bending portions 52 bending upwardly from the bottom wall 51 and a pair of fixing plates 53 extending outwardly from two sides of the bending portions 52. Each fixing plate 53 includes a penetrating hole 531.

In the process of making the electrical connector 100, the upper terminals 21 are affixed to the first insulator 11 via an insert-molding process. The lower terminals 22 are affixed to the second insulator 12 via another insert-molding process. The contacting portions 21 of the conductive terminals 2 are exposed to an upper surface of the first tongue portion 112 and a lower surface of the second tongue portion 122. The fixing portions 25 are affixed to the first insulator 11 and the second insulator 12. The soldering portions 24 extend outwardly from a rear end of the first insulator 11 and the second insulator 12.

Figure 12:
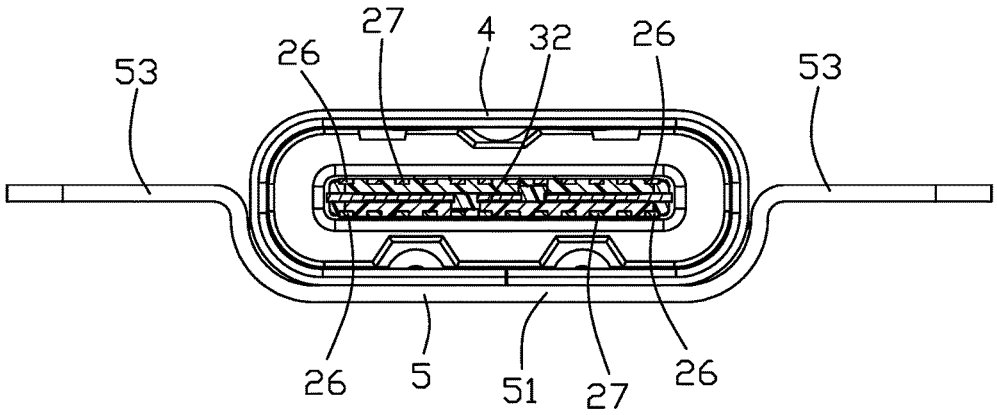
FIG. 12 is a cross-sectional view of the electrical connector taken along line 12-12 in FIG. 1.

Referring to FIGS. 6 to 7 and FIG. 12, sandwich the metal shielding plate 3 between the first insulator 11 and the second insulator 12 in a vertical direction perpendicular to the front-to-rear direction. The second locking portions 123 are buckled with the first locking portions 113. The buckling portion 125 is stuck in the buckling hole 117. The third mating holes 36 communicate the first mating holes 114 and the second mating holes 124 in the vertical direction. The supporting portion 31 is sandwiched between the first base portion 111 and the second base portion 121. The first insulator 11 contacts with the second insulator 12 by the through hole 35 located at the middle of the connecting portion 33. The main portion 32 and the fixing protrusions 34 are sandwiched between the first insulator 11 and the second insulator 12 making the fixing protrusions 34 sandwiched between the first tongue portion 111 and the second tongue portion 121 and extending outwardly from the lateral sides of the first tongue portion 111 and the second tongue portion 121. The main portion 32 and the inclining portions 38 are sandwiched between the contacting portions 23 of the upper terminals 21 and the contacting portions 23 of the lower terminals 22. The contacting portions 23 of the grounding terminals 26 are opposite rightly to the inclining portion 38 making the distance between the contacting portions 23 of the internal terminals 27 and the metal shielding plate 3 greater than the distance between the contacting portions 23 of the grounding terminals 26 and the metal shielding plate 3.

Referring to FIG. 5, insert-molding the insulative materials with the first insulator 11 and the second insulator 12 to be the insulative housing 1 including the third insulator 13. The fixing protrusions 34 are received in the fixing grooves 136.

Referring to FIGS. 1 to 4, the insulative housing 1 is received in the metal shell 4. The first tuber 412 resists the receiving groove 133. The resisting portions 411 resist against with the slots 115. The second tubers 421 resist the recesses 134. The positioning pins 431 resist against a rear surface of the third insulator 13 and affixed to the resisting grooves 116.

The metal shell 5 is spot-welded on the bottom wall 42 making the bending portions 52 cover the lateral walls 43.

Compared with prior arts, the metal shielding plate 3 includes the main portion 32, the pair of fixing protrusions 34 located at two sides of a front end of the main portion 32 and a pair of inclining portions 38 located at a pair of outer edge of the main portion 32 and connecting with the fixing protrusions 34. Subject to the industry specification, the metal shielding shell 3 has a certain thickness. The metal shielding shell is punched making the thickness of the main portion 32 less than that of the fixing protrusions 34. The thickness of the inclining portions 38 is between the thickness of the main portion 32 and the fixing protrusions 34 so as to provide smooth transition between the main portion 32 and the fixing portions 34 without jeopardizing the interior rigidity thereof. The distance between the contacting portions 23 of the internal terminals 27 and the main portion 32 is greater than the distance between the contacting portions 23 of the grounding terminals 26 and the inclining portions 38 increasing withstanding of voltage. In this embodiment, the main portion 32 is thinned compared with the inclining portions 38 via a pressing/forging operation for increasing density thereof so as to assure the required rigidity thereof even if the thickness dimension is less than that of the inclining portions 38. It is noted that in this embodiment the main portion 32 is essentially located among the front fixing portions 34, the inclining portions on two sides, and the associated supporting portion 31 and connecting portions 33 in a protectively surrounded manner, all of which have the larger thickness than the main portion 32. This is also another reason why the main portion 32 is allowed to occupy most portions of the tongue portion 15 without improperly jeopardizing the strength of the tongue portion 15. Notably, the main portion 32 forms a plurality of through holes (not labeled) for receiving material of the third insulator 13 therein. Another feature of the invention is to have the shielding plate 3 forms a space (not labeled) in a front end region, which is surrounded by the pair of fixing protrusions 34 and the front edge of the main portion 32, and is adapted to be filled with material of the third insulator 13 in a later time as well as the aforementioned through holes in the main portion 32.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion;

a plurality of conductive terminals affixed to the insulative housing and arranged in two rows, each conductive terminal comprising a contacting portion, and each row of conductive terminals comprising a pair of grounding terminals and a plurality of internal terminals located between the pair of grounding terminals;

a metal shielding plate affixed to the insulative housing and sandwiched between the two rows of conductive terminals; and a main shell enclosing the insulative housing;

wherein the metal shielding plate comprises a main portion and a pair of fixing protrusions located at two sides of a front end of the main portion, the main portion and the fixing protrusions are affixed to the insulative housing, and a thickness of the main portion is less than that of the fixing protrusion; and wherein the metal shielding plate comprises a supporting portion and a pair of connecting portions connecting the supporting portion and the main portion, and a thickness of the main portion is less than that of the supporting portion and less than that of the connecting portion.

2. The electrical connector as claimed in claim 1, wherein the metal shielding plate comprises a pair of inclining portions located at a pair of outer edges of the main portion and connecting with the fixing protrusions, and each inclining portion comprises an arc surface inclined from the fixing protrusion to the main portion and connecting the fixing protrusion with the main portion.

3. The electrical connector as claimed in claim 2, wherein a thickness of the inclining portion is greater than that of the main portion and less than that of the fixing protrusion, and the contacting portions of the grounding terminals are opposing the inclining portions while the contacting portions of the internal terminals are opposing the main portion.

4. The electrical connector as claimed in claim 1, wherein the insulative housing comprises a first insulator having a first base portion and a first tongue portion extending forwardly from the first base portion, a second insulator having a second base portion and a second tongue portion extending forwardly from the second base portion, and a third insulator having a third base portion and a third tongue portion extending forwardly from the third base portion, the third tongue portion comprises a pair of fixing grooves located laterally, the fixing protrusions are sandwiched between the first tongue portion and the second tongue portion and extend forwardly, and the fixing protrusions are stuck in the fixing grooves.

5. The electrical connector as claimed in claim 4, wherein the metal shielding plate comprises a supporting portion having a pair of third mating holes located at two lateral sides thereof, the first base portion comprises a pair of first mating holes located at two lateral sides thereof, the second base portion comprises a pair of second mating holes located at two lateral sides thereof, and the third mating holes communicate with the first mating holes and the second mating holes in a vertical direction.

6. The electrical connector as claimed in claim 4, wherein the first base portion comprises a pair of lateral first locking portions, the second base portion comprises a pair of second locking portions extending upwardly and mated with the first locking portions, the first tongue portion comprises a buckling hole in a front end thereof, and the second portion comprises a buckling portion extending upwardly and engaged with the buckling hole.

7. The electrical connector as claimed in claim 1, wherein the base portion comprises a pair of slots in an upper surface thereof, a receiving groove located in front of the slots, and a pair of recesses in a lower surface thereof, the main shell comprises an upper wall having a pair of resisting portions and a first tuber located in front of the resisting portions, a lower wall located opposite to the upper wall and having a pair of second tubers, the resisting portions resist the slots, the first tuber is received in the receiving groove, the second tubers resist the recesses, and the upper wall is longer than the lower wall in an insertion direction.

8. The electrical connector as claimed in claim 1, further comprising a metal shell having a bottom wall and a pair of bending portions extending upwardly from the bottom wall, and wherein the main shell comprises a pair of lateral walls connecting the upper wall and the lower wall, and the metal shell is spot-welded on the lower wall of the main shell in order to cover the lateral walls by the bending portions.

9. An electrical connector for mating with a complementary plug connector, comprising:

an insulative housing including a base portion and a tongue portion extending forwardly in a front-to-back direction from the base portion and defining opposite first and second surfaces thereon in a vertical direction perpendicular to said front-to-back direction;

two rows of terminals disposed in the housing with corresponding contacting sections exposed upon the first and second surfaces, respectively;

a metallic shielding plate embedded in the tongue portion; wherein said metallic shielding plate includes a pair of side portions on two lateral sides in a transverse direction perpendicular to both said front-to-back direction and said vertical direction, a pair of fixing protrusions, for locking the complementary plug connector, connected at front ends of said pair of side portions, respectively, a supporting portion located behind the pair of side portions in the front-to-back direction and upwardly offset from the pair of side portions in the vertical direction, and a main portion unitarily linked between the pair of side portions and surrounded by said pair of side portions, the pair of fixing protrusions and the supporting portion and located at a same level with the pair of side portions; wherein the main portion is embedded within the tongue portion, and a thickness of the main portion is smaller than that of the side portion, smaller than that of the fixing protrusion, and smaller than that of the supporting portion in the vertical direction.

10. The electrical connector as claimed in claim 9, wherein a space is formed around a front edge of the main portion and between the pair of fixing protrusions, and is adapted to be filled with material of a supplemental insulator which is a part of the housing.

11. The electrical connector as claimed in claim 10, wherein the main portion forms a plurality of through holes filled with the material of the supplemental insulator.

12. The electrical connector as claimed in claim 10, wherein one row of said two rows of terminals are integrally formed within a first insulator, the other row of said two rows of terminals are integrally formed within a second insulator, and said first insulator cooperates with said second insulator to commonly sandwich the shielding plate therebetween so as to have the supplemental insulator applied thereon to finalize the whole housing.

13. The electrical connector as claimed in claim 9, further including a pair of connecting portions linked between the pair of side portions and the supporting portion in the front-to-back direction, and extending in an oblique direction relative to the main portion, wherein a through hole is formed among the pair of connecting portions, the supporting portion and the main portion, and a rear edge of the main portion reaches said through hole.

14. The electrical connector as claimed in claim 9, wherein the side portion includes an inclining section to gradually comply with the thickness of the main portion for smooth transition consideration between the main portion and the fixing protrusions.

15. The electrical connector as claimed in claim 9, wherein in the shielding plate, a density of said main portion is larger than those of the side portions, the fixing protrusions and the supporting portion.

16. An electrical connector for mating with a complementary connector, comprising:

an insulative housing including a base portion and a tongue portion extending forwardly in a front-to-back direction from the base portion and defining opposite first and second surfaces thereon in a vertical direction perpendicular to said front-to-back direction;

two rows of terminals disposed in the housing with corresponding contacting sections exposed upon the first and second surfaces, respectively;

a metallic shielding plate embedded in the tongue portion; wherein said metallic shielding plate includes a pair of side portions on two lateral sides in a transverse direction perpendicular to both said front-to-back direction and said vertical direction, a pair of fixing protrusions, for locking the complementary plug connector, connected at front ends of said pair of side portions, respectively, and a main portion unitarily linked between the pair of side portions; wherein the main portion is embedded within the tongue portion, and a thickness of the main portion is smaller than that of the of side, portion and smaller than that of the fixing protrusion in the vertical direction; wherein the side portion includes an inclining section to gradually comply with the thickness of the main portion for smooth transition consideration between the main portion and the fixing protrusions.

17. The electrical connector as claimed in claim 16, wherein a space is formed around a front edge of the main portion and between the pair of fixing protrusions, and is adapted to be filled with material of a supplemental insulator which is a part of the housing.

18. The electrical connector as claimed in claim 16, wherein in the shielding plate, a density of said main portion is larger than that of the side portion and larger than that of the fixing protrusion.

* * * * *